US008382960B2

(12) United States Patent
Paul et al.

(10) Patent No.: US 8,382,960 B2
(45) Date of Patent: Feb. 26, 2013

(54) ARRANGEMENT FOR GUIDING A DRILL STEM OF A DECOKING TOOL

(75) Inventors: Wolfgang Paul, Hamburg (DE); Dirk Heidemann, Schwerte (DE); Maciej Barcikowski, Bochum (DE); Hauke Jasper, Witten (DE)

(73) Assignee: Ruhrpumpen GmbH (DE)

( * ) Notice: Subject to any disclaimer, the term of this patent is extended or adjusted under 35 U.S.C. 154(b) by 698 days.

(21) Appl. No.: 12/597,272

(22) PCT Filed: Apr. 25, 2008

(86) PCT No.: PCT/EP2008/003378

§ 371 (c)(1),
(2), (4) Date: Oct. 23, 2009

(87) PCT Pub. No.: WO2008/131933

PCT Pub. Date: Nov. 6, 2008

(65) Prior Publication Data

US 2010/0111625 A1 May 6, 2010

(30) Foreign Application Priority Data

Apr. 25, 2007 (DE) ..... 10 2007 019 868

(51) Int. Cl.
*C10B 43/02* (2006.01)

(52) U.S. Cl. ..... 202/239; 196/122; 202/241; 408/241 R

(58) Field of Classification Search ..... 202/239, 202/241, 242, 250, 268, 270; 201/2; 196/122; 408/97, 115 R, 241 R, 241 G; 134/167 R, 134/177

See application file for complete search history.

(56) References Cited

U.S. PATENT DOCUMENTS

| | | | | |
|---|---|---|---|---|
| 1,618,633 | A * | 2/1927 | Bennett et al. | 202/258 |
| 1,767,795 | A * | 6/1930 | Huff | 15/104.096 |
| 2,245,554 | A * | 6/1941 | Court | 134/24 |
| 5,022,799 | A * | 6/1991 | Torres et al. | 408/1 R |
| 5,092,963 | A * | 3/1992 | Barker et al. | 202/250 |
| 5,290,076 | A | 3/1994 | Smith | |
| 5,846,034 | A | 12/1998 | Martin et al. | |
| 6,652,714 | B1 * | 11/2003 | Breaux | 202/241 |
| 7,037,408 | B2 * | 5/2006 | Wilborn et al. | 201/2 |
| 2004/0253066 | A1 | 12/2004 | Paul et al. | |
| 2006/0086539 | A1 | 4/2006 | Koerner et al. | |
| 2006/0254902 | A1 | 11/2006 | Terwisscha et al. | |

FOREIGN PATENT DOCUMENTS

| | | |
|---|---|---|
| EP | 1024186 A2 | 8/2000 |
| EP | 1409164 B1 | 4/2004 |

OTHER PUBLICATIONS

International Preliminary Report dated Nov. 10, 2009.
International Search Report dated Jan. 8, 2009.

* cited by examiner

*Primary Examiner* — Jill Warden
*Assistant Examiner* — Joye L Woodard
(74) *Attorney, Agent, or Firm* — Luedeka Neely Group, P.C.

(57) ABSTRACT

So-called decoking, in other words, the emptying of a container in which coke arising from the operation of a refinery is deposited and carried out using a decoking tool with a free mounting on the end of a drilling bar. The mounting is achieved using a sliding guide on a guide plate, coupled to the container. Distortions in the container and the guide plate therewith as a result of temperature variations during operation of the refinery which could lead to function disturbance of the drilling rod are avoided, wherein the sliding guide and the guide plate are arranged with a spring relative deflection by at least one spring element in the manner of a spring damper.

14 Claims, 10 Drawing Sheets

ARRANGEMENT FOR GUIDING A DRILL STEM OF A DECOKING TOOL

FIELD OF THE INVENTION

The present invention relates to an arrangement for guiding a drill stem of a decoking tool working in the interior of a container filled with coke with respect to the container.

BACKGROUND

Decoking systems have a container, which slowly fills with coke during the operation of the refinery. This coke must be flushed out from time to time. For this purpose, a decoking tool is introduced into the interior of the container from its top end. The decoking tool is carried by a hollow drill stem, which is connected to a drive which, in the operating state, causes the drill stem to rotate together with the tool. The drill stem is arranged on a slide, which is guided and can be lifted and lowered between sections of a tower above the container. It has a pressurized-water fitting at its top end. The length of the drill stem corresponds at least to the height of the container to be emptied. It is essentially stored, guided and driven outside of the container and is capable of guiding the decoking tool to the bottom of the container.

Decoking, i.e. emptying the coke containers, is carried out using water supplied at a high pressure of more than 100 bar by the drill stem and that shoots out through nozzles arranged on the tool and selectively removes the coke deposited in the interior of the container. During decoking, the tool traverses the entire height of the interior along the longitudinal axis of the container. Once the coke has been flushed out, the decoking tool is retracted into a rest position at the top end of the container. With regard to the good functioning of this tool together with its guiding, it must be taken into consideration that the coke container expands or contracts depending on the temperature during operation of the refinery. Due to the size of the container, deformations result changing the position of the guiding of the drill stem of the decoking tool. The drill stem of the decoking tool should be suspended precisely below the drive of the tool. Due to the thermally induced shape variations of the container, however, there is a displacement of a guide plate mounted at the top of the decoking container or above the same, usually flanged there, if necessary, with the interposition of a valve or a slide and an adapter, and on which the drill stem is guided, which connects the decoking tool and the drive. The forces applied to the drill stem by the displacement of the guide plate, are undesirable. They lead to the drill stem being prematurely worn.

The exposure of the drill stem to such undesirable forces due to the thermally induced deformation of the container occurs both in the case that centering of the drill stem is carried out directly or indirectly on the container, and in the case that the drill stem is guided in the tower above the container and relative displacements arise between the tower and the container. In the latter case the container, if deformed due to thermal stresses, is no longer centered below the tower where the drill stem is guided.

It is known from the state of the art to enlarge the opening in the guide plate through which the drill stem is guided. It is thus avoided that the drill stem is undesirably deflected by radial forces. However, the drill stem is no longer sufficiently guided, it wobbles in the operating state and is damaged thereby. Consequently, this prior art approach is not satisfactory.

SUMMARY OF THE INVENTION

It is therefore the object of the present invention to suggest an arrangement for guiding the drill stem of a decoking tool which ensures smooth operation even in the case of deformation of the container due to thermal stresses. The objective is therefore to avoid deleterious effects on the drill stem or its guiding due to the deformation of the container.

Based on a well-known arrangement for guiding the drill stem of a decoking tool working in the interior of a coke container with respect to the container, comprising

- a guide plate to be mounted on the container, and
- a drill stem carrying the decoking tool at its lower end, which can pass through an opening of the guide plate, and which is guided in a sliding guide mounted on the guide plate, the above object is achieved

- by arranging the sliding guide of the drill stem and the guide plate in a manner by which they are spring-deflected with respect to each other.

According to the present invention, the guiding of the drill stem of the decoking tool is thus connected to the guide plate in an arrangement having an effect of ensuring spring-deflective positioning between these two components of the system. In other words, the sliding bearing and the guide plate are arranged in a manner that is decoupled and capable of spring-deflection with respect to each other so that by providing at least one spring element a relative movement is enabled between the drill stem guiding means and the guide plate. The guide plate fixedly flanged on the container moves together with the flange of the container as it undergoes thermally induced shape variations. This movement is not transferred, however, to the drill stem, as before, but is compensated by the sprung arrangement between the sliding guide of the drill stem and the guide plate, which can have a shock absorbing effect.

The drill stem is preferably provided with a sliding bearing. The sliding bearing is usually surrounded by a housing. It is advantageous, if the at least one spring element or the sprung arrangement is applied to the sliding bearing or, if necessary, on the housing, thus connecting the sliding bearing and/or the housing with the structure of the tower. This is how the sliding bearing or the housing is decoupled from the guide plate to enable the relative movement according to the present invention. The guide plate continues to follow any deformation of the container while the sliding bearing or the housing remain aligned with the tower structure to guide the drill stem so that guiding of the drill stem is not negatively affected by the movement of the guide plate.

To implement the invention it is also possible, and it may be advantageous under structural and functional considerations, to achieve relative spring-deflection capability by decoupling the housing from the guide, i.e. to fixedly mount the housing on the guide plate and to configure the guiding of the drill stem in a spring-deflective manner with respect to the housing.

To achieve the spring-deflection capability, i.e. to enable a relative movement between the drill stem guide and the guide plate, in the simplest case, one spring element is sufficient. It is preferable, however, for reasons of construction, in particular in view of the necessary centering and depending on the available space, to provide at least two, preferably three, four or five spring elements between the drill stem, or between the sliding bearing of the drill stem and/or the housing on the one hand, and the tower construction on the other. If the spring-deflection capability is arranged between the sliding bearing and the housing, the housing can be fixedly mounted on the guide plate. This achieves particularly smooth, unaffected guiding of the drill stem. Spatial expansions of the container—and therefore of the guide plate—arising in various horizontal directions, can be better compensated by a plurality of spring elements. Preferably, the spring elements are uniformly spaced on a circumference surrounding the drill stem.

It is advantageous to configure the characteristic of the at least one spring element in such a way that it compensates positional variations of the guide plate, in particular. At the same time, it can also be configured to compensate smaller bumps and shocks arising during the decoking process.

According to an advantageous embodiment of the invention, the at least one spring element is provided as a spring damper. Advantageously, the latter acts like a shock absorber.

In an alternative embodiment of the invention, the guide plate essentially consists also of a flange, which is fixedly connected with the flange of the valve or the slide, or the interposed adapter. According to the present invention, a receiving means is fitted on a housing attached to the guide plate, which essentially extends transverse to the axis of the drill stem and in which a guide member connected with the sliding guide of the drill stem is supported in a manner capable of radial spring-deflection. In this arrangement, a radially floating support in the receiving means results for the guide member connected to the sliding guide of the drill stem, which is preferably arranged at the top of the housing attached to the guide plate. As the container is deformed due to thermally induced stresses and as the container opening as well as the valve, the adapter and the guide plate attached thereto experience positional variations therefrom, the guide member with the sliding guide of the drill stem can maintain its central position by executing a compensatory movement radially, preferably by spring-deflection, within the receiving means and relative to it, while the guide plate moves together with the container opening.

Preferably, the guide member is supported by means of spring elements on a frame indirectly or directly connected to a tower of sections—known as such—above the container. The guide member, and with it the sliding guide of the drill stem, is thus suspended from the frame only by the spring elements. Since the guiding member is supported in a floating manner, i.e. with a radial deflection capability, within the receiving means, the housing mounted on the guide plate can move together with the container opening in a radial direction, should thermally induced deformations of the container arise, while the guide member—since it is only held by the spring elements—remains in a central position within the frame.

Preferably, the receiving means and the guide member each have an annular construction. They thus surround an opening for the passage of the drill stem and preferably also the decoking tool.

Preferably, it is further provided that an inner housing embracing the sliding guide of the drill stem is in connection with the radially deflective guide member. The inner housing protects the nozzles of the decoking tool.

Preferably, this inner housing is vertically moveably guided relative to the outer housing fixed on the guide plate and within the guiding member. Two preferred positions of the drill stem are thus possible when it is in a position above the container. Then, the tool can assume a position in the inner housing either on the level of the outer housing, from which it is lowered together with the drill stem for working in the interior of the container, or the tool can be lifted together with the inner housing into a position above the plane of the suspension, i.e. out of the outer housing, so that the decoking tool is accessible and can be taken out, such as in the case of replacement.

Preferably, the spring elements are each pivotably linked with the frame and with the guiding member. Due to this pivotable linking of the spring elements, relative movements of the guiding member are possible in a limited manner. Otherwise, the function of the spring elements is essentially to compensate, or dampen, bumps and shocks.

The guiding member preferably consists of a bearing sleeve and an annular plate portion radially protruding from it, with which the guiding member is supported in an annular slot capable of radial deflection within the receiving means. The annular slot has a substantially greater diameter—depending on the relative displacements to be expected—than the annular plate portion floatingly supported in the annular slot.

BRIEF DESCRIPTION OF THE DRAWINGS

Preferred embodiments of the invention will be described in more detail in the following with reference to the accompanying drawings, in which.

DETAILED DESCRIPTION OF THE PREFERRED EMBODIMENT(S)

Figure 1:
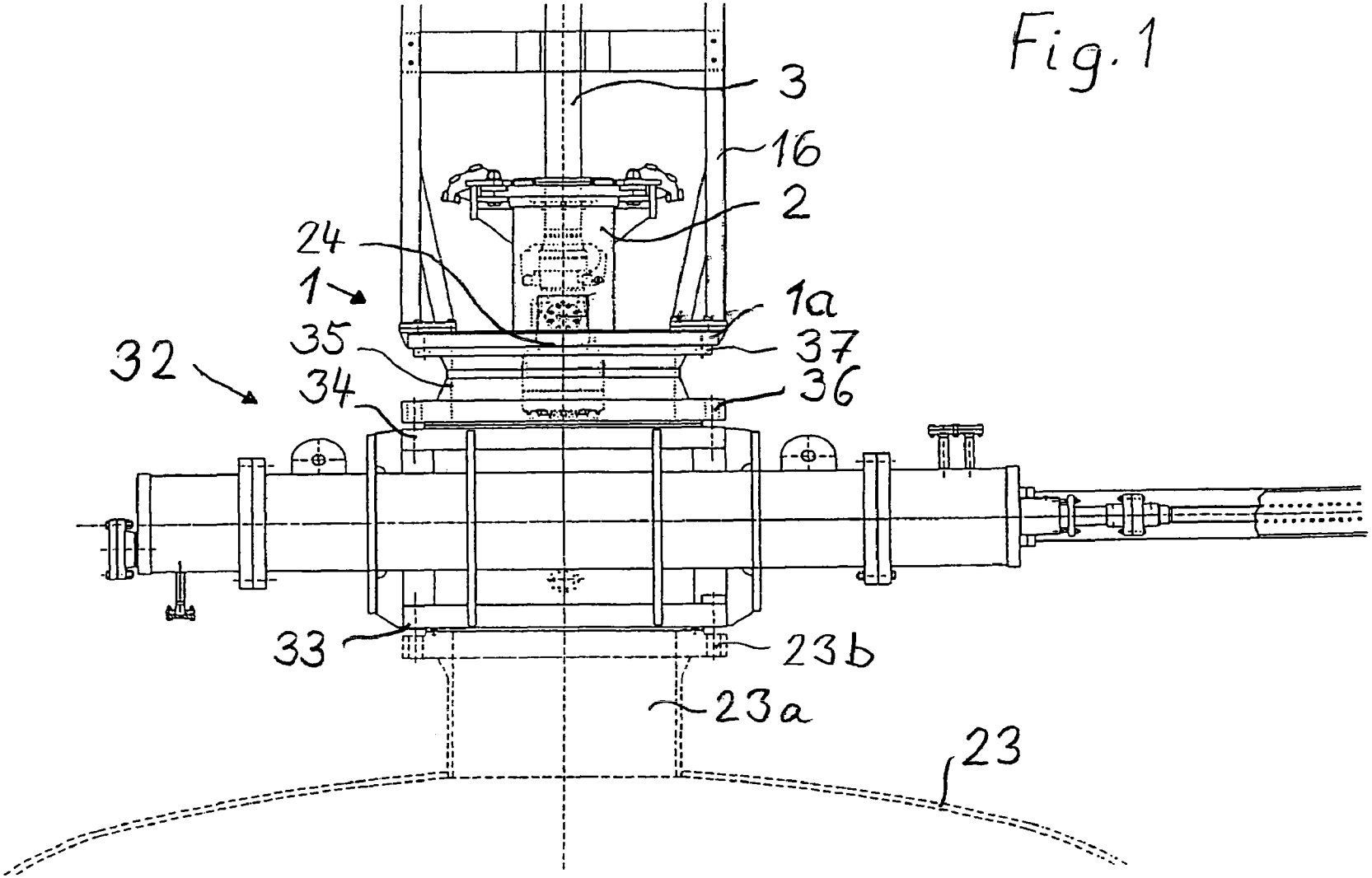
FIG. 1 is a schematic side view of a guide plate set on a container with the interposition of a slide and an adapter according to the state of the art.

The arrangements shown in the drawings for guiding a drill stem 3 of a decoking tool 24 are to be fitted on a container 23 of decoking systems.

A well-known example of such an arrangement is shown in FIG. 1. A guide plate 1, forming the basis of the guide of the drill stem 3, is fixedly connected with container 23 in the operation of the arrangement. To achieve this, a container flange 23*b* of a container opening 23*a* is fixedly bolted to a lower flange 33 of a valve 32, serving to open and close container opening 23*a* and needs not be further described here. A top flange 34 of valve 32 is fixedly connected with guide plate 1, by fixedly connecting a top flange 34 with a bottom flange 36 of an interposed adapter 35. A top flange 37 of adapter 35 is bolted to a flange 1*a* of guide plate 1. A frame 16 on guide plate 1 will be explained with exemplary embodiments of the invention as will be a centrally arranged housing 2. When the components are positioned as in FIG. 1, drill stem 3 can be lowered together with decoking tool 24 to break up coke in container 23, once valve 32 has been opened. The same position also results after emptying of container 23.

Figure 3:
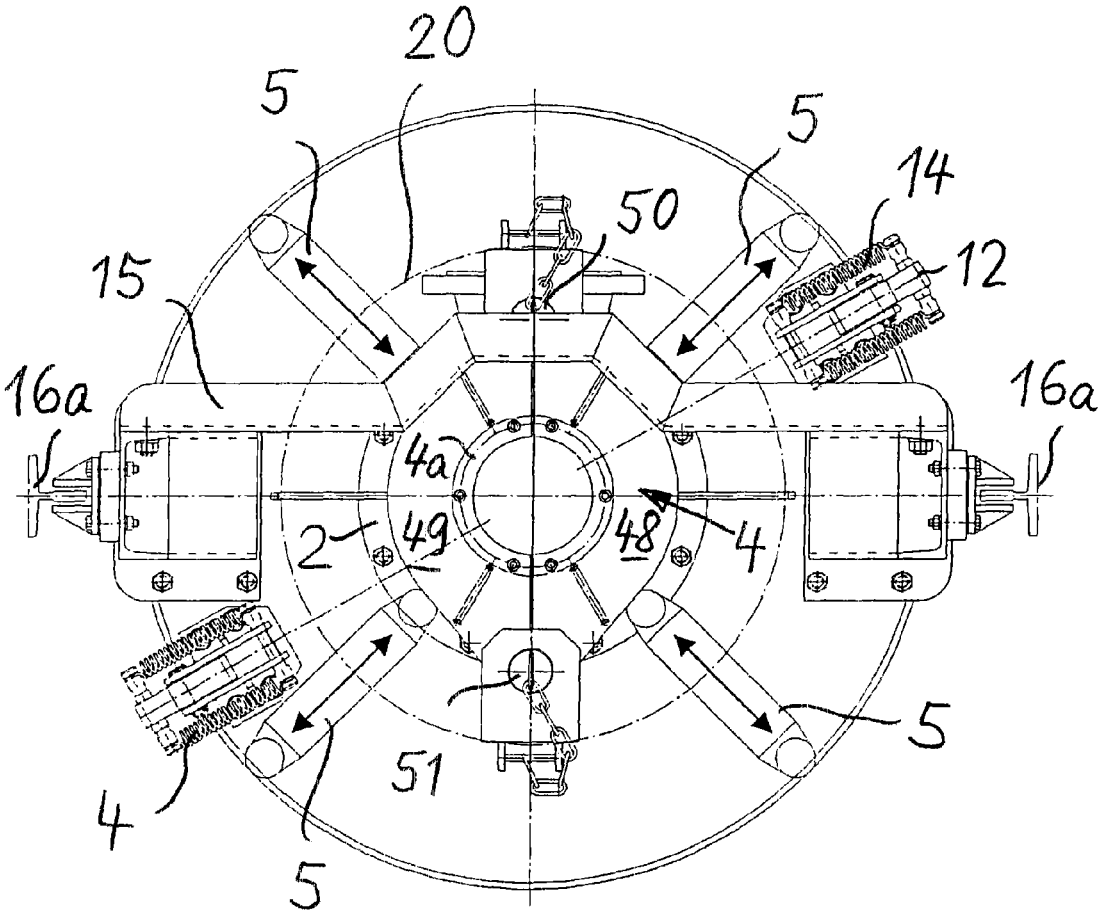
FIG. 3 is a plan view of FIG. 1.
Figure 4:
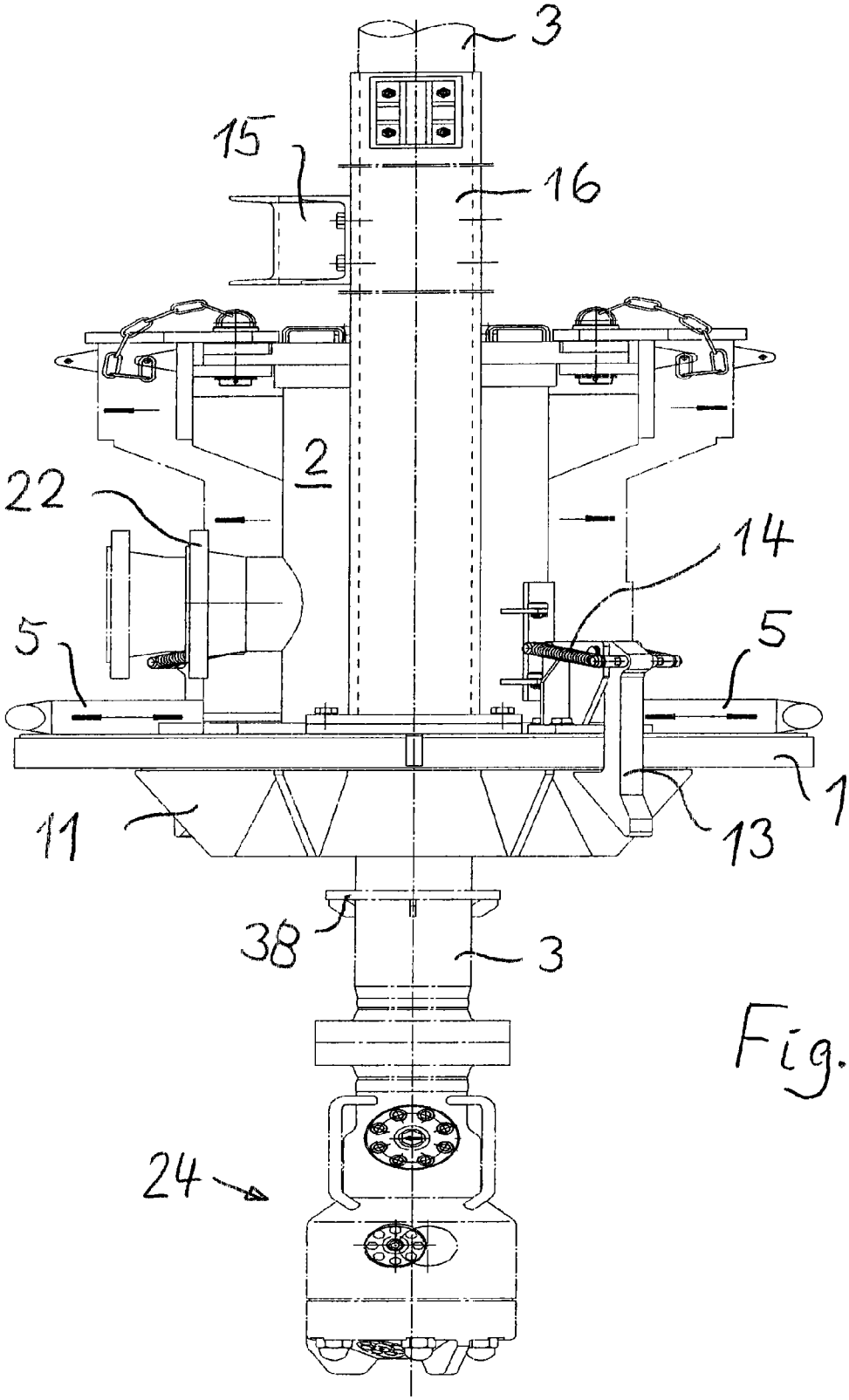
FIG. 4 is a side view as in FIG. 1, but rotated by 90°.

In a first exemplary embodiment of the invention (FIGS. 2-4), a conical member 11 is provided at the underside of guide plate 1, wherein conical member 11 protrudes into the opening of adapter 35, while releasable locks 12 are provided for connecting purposes. Locks 12, which are deemed to be an independent inventive approach for fixing guide plate 1 on valve 32 with the applied adapter 35, have a detent 13 and a spring 14 for fixing detent 13 in its locking position. As guide plate 1 is lowered toward container 23, detents 13 slide over flange 37 on interposed adapter 35 and automatically reach under this flange 37 in a locking manner. This is ensured by spring 14 holding detent 13 below a dead point.

Figure 2:
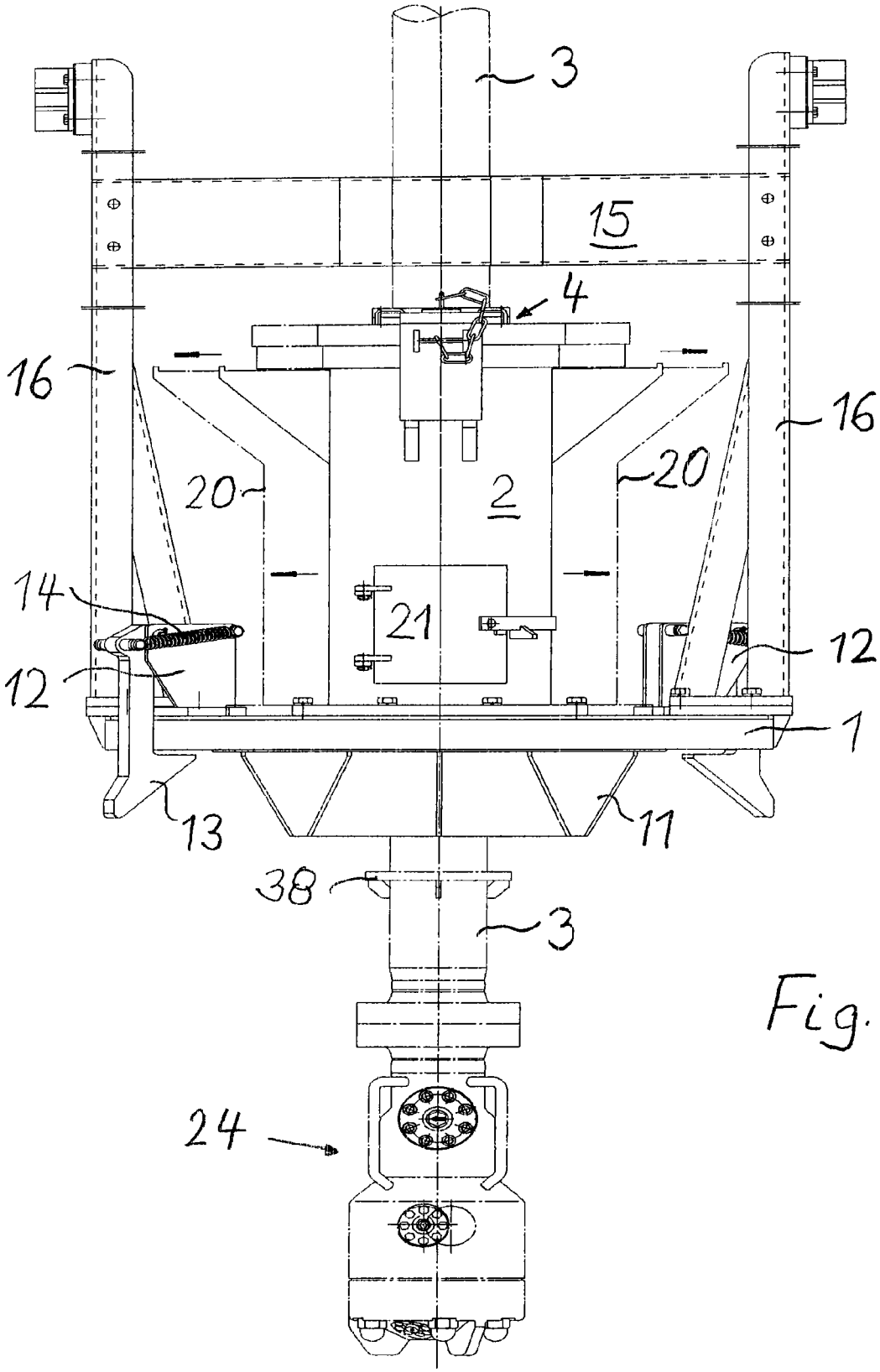
FIG. 2 is a side view of a first embodiment of the invention.

Once container 23 has been emptied, drill stem 3 together with decoking tool 24 is retracted, as is well known, into a parking position above container 23. To do this, guide plate 1, together with the superstructure on it, is lifted by drill stem 3. In FIG. 2, above decoking tool 24, a catching flange 38 is indicated on drill stem 3. As guide plate 1 is lifted from container 23, or from adapter 35, detent 13 of locking means 12 must first be released from adapter flange 37. Detent 13 is either manually moved and lifted beyond the dead point, or the operation of detent 13 is carried out automatically by an electric, pneumatic or hydraulic drive (not shown), for example.

Guide plate 1 carries a frame 16 on its top surface, which is flanged thereto (FIGS. 2-4) and, in turn, forms the support for a guide bracket 15 extending essentially parallel to the plane of guide plate 1. Frame 16 is guided on guide rails 16*a* (FIG. 3) of a tower, not shown, forming a framework of sections above container 23 in the well-known manner and in which a slide carrying a drill stem connection is arranged in a liftable and lowerable manner. This construction serves to support and provide guidance for guide plate 1 and therefore, as will be explained, drill stem 3 carrying at its lower end in a free-floating bearing the decoking tool 24, which works in the interior of container 23.

A housing 2 is attached at or on guide plate 1, horizontally displaceable in a sprung manner. Sliding guide 4, or sliding bearing 4*a*, of drill stem 3 is received in housing 2. While this housing 2 is shown in its basic position by solid lines, it can move radially relative to guide plate 1 into the extreme positions 20 indicated by dash-dotted lines in FIGS. 2, 3 and 4 (cf. also circle 20 in FIG. 3) in the extreme case due to temperature-induced shape variations of container 23, and thus of guide plate 1. Drill stem 3 together with housing 2 guided within housing 2 by means of sliding guide 4 moves relative to guide plate 1 into the corresponding positions. To enable and to control this radial relative movement, housing 2 is supported for spring-deflection with respect to guide plate 1 with the aid of spring elements 5 between frame 16, or guide plate 1, and housing 2.

Spring elements 5 are configured as spring-damper elements and are preferably pivotably linked by means of screwed bolts with one end on housing 2 (FIG. 3) and with the other end on guide plate 1 or frame 16. To be able to optimally control the changes in position of container 23 due to heat deformation and to ensure sufficient centering of housing 2, four such spring elements 5 are attached to housing 2 at essentially uniform angular distances. Any other number of spring elements 5 reasonable from the point of view of construction is also possible as long as it ensures the spring-deflected displacement function of housing 2 relative to guide plate 1 and thus the maintenance of the central position of drill stem 3 which enables an unaffected smooth rotation of decoking tool 24 sitting on the other end of drill stem 3 within container 23.

A flap 21 forms an access means to the switch for manual switchover of the working functions of decoking tool 24, which need not be explained in any more detail, because it is part of the state of the art. The same applies to a connection 22 indicated in FIG. 4, which serves to attach an elastic hose connected with the interior of housing 2 and container 23 for pressure relief purposes.

Figure 5:
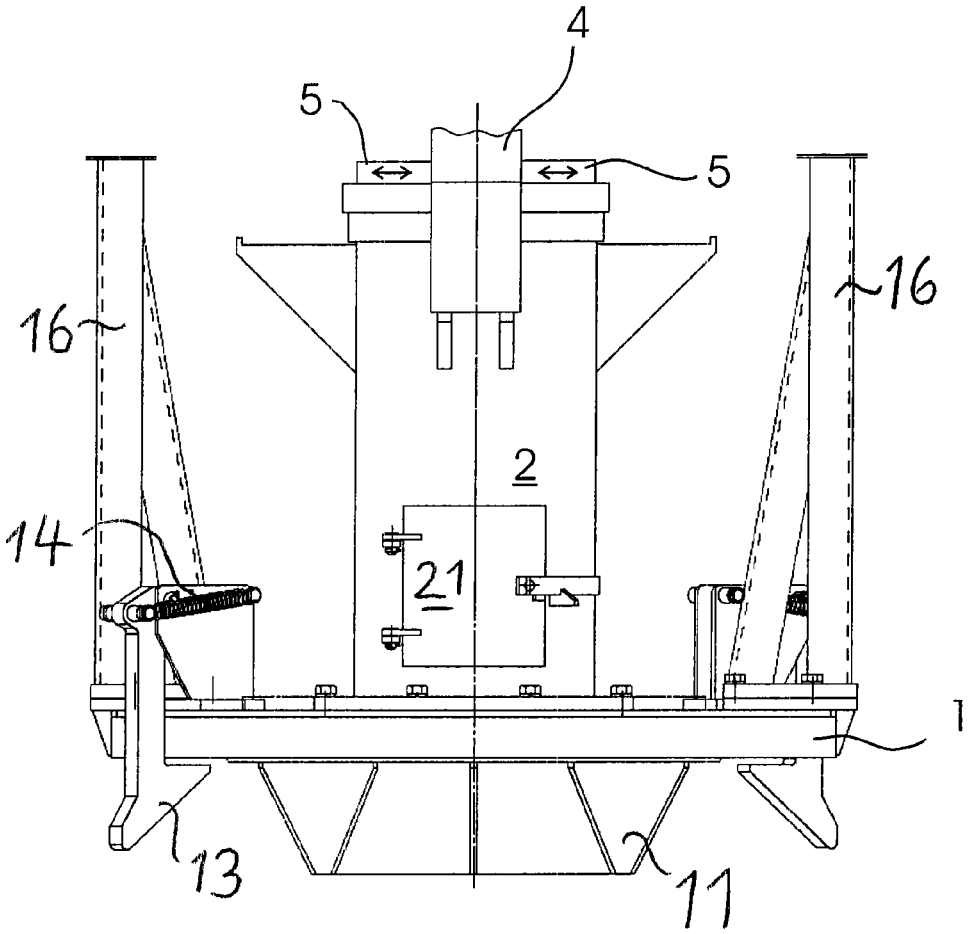
FIG. 5 is a side view similar to FIG. 1, but of a second embodiment of the present invention.
Figure 6:
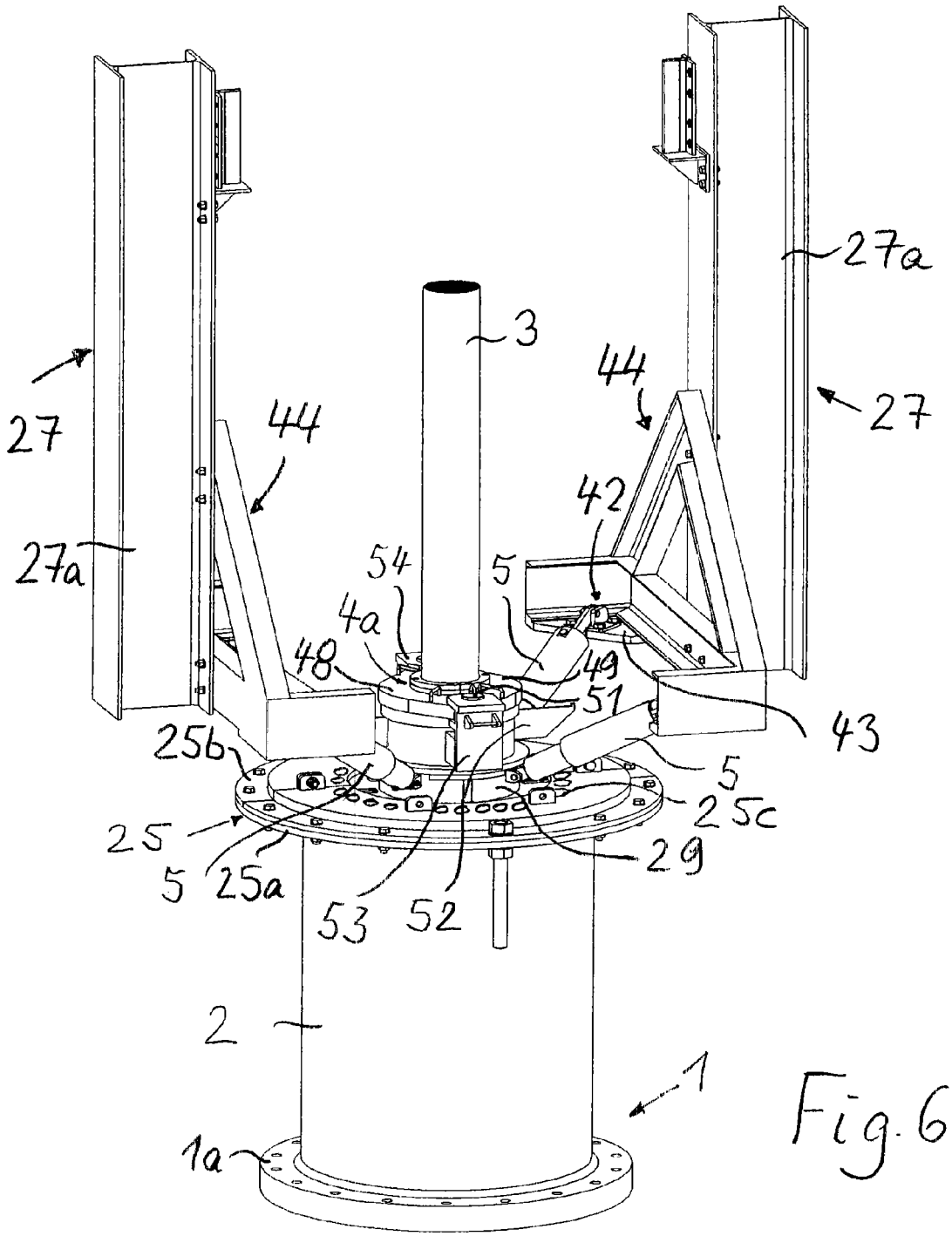
FIG. 6 is a perspective view of a further arrangement according to a third exemplary embodiment of the invention.
Figure 7:
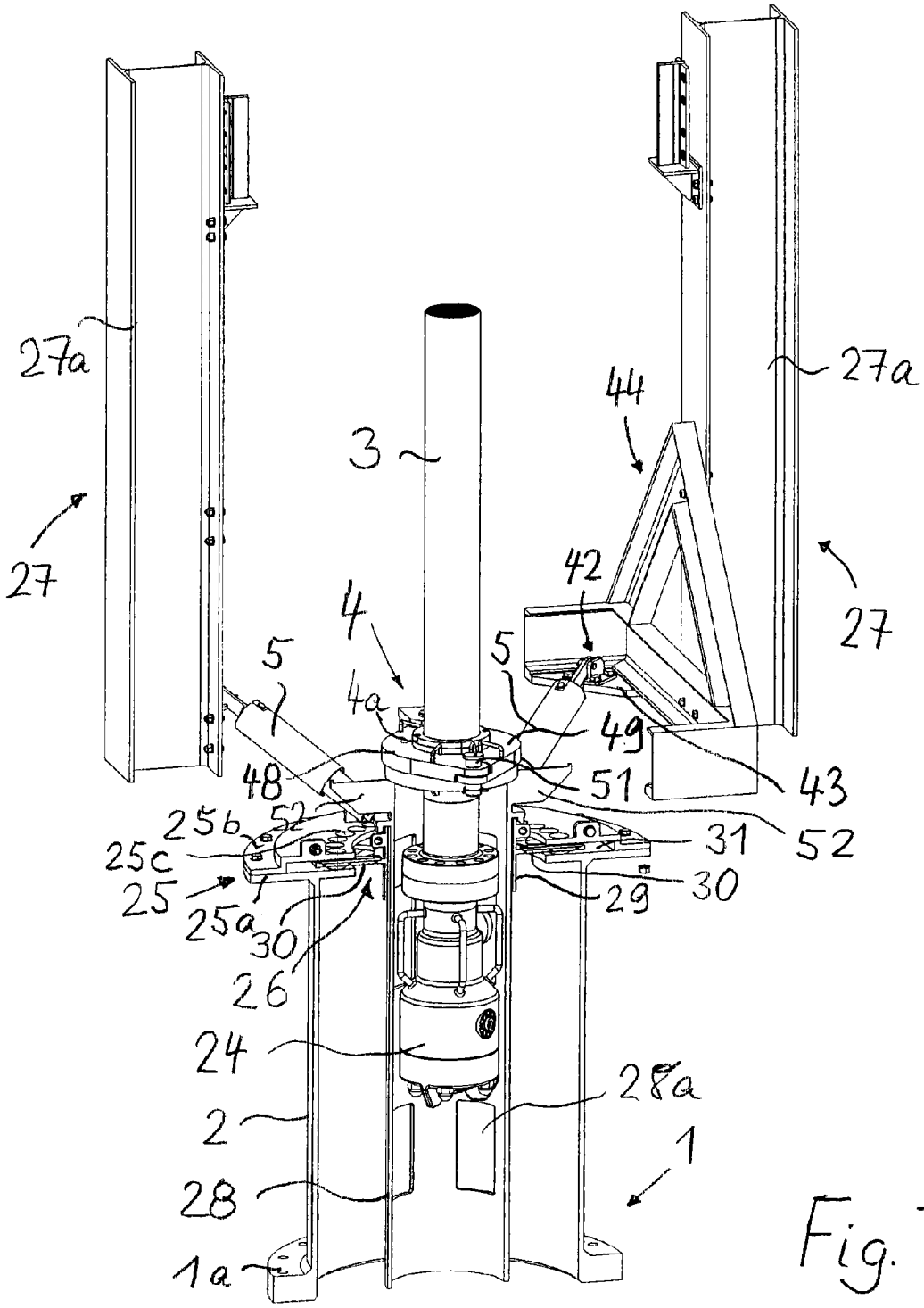
FIG. 7 is a perspective view of the arrangement of FIG. 6, showing, however, an outer and an inner housing in a sectional view.

A second embodiment of the arrangement according to the present invention, according to FIG. 5, shows a housing 2 fixedly connected with guide plate 1. Two spring elements 5 are arranged on the top of housing 2, which connect housing 2 with sliding guide 4 or the sliding bearing of drill stem 3 or with an attachment fitted on drill stem 3 in a manner capable of spring-deflection.

In the third exemplary embodiment of the invention according to FIGS. 6-11, guide plate 1 essentially consists of flange 1*a* for attaching guide plate 1 on top flange 37 of adapter 35 (FIG. 1). In the present case, housing 2 is fixedly connected with flange 1*a* and has an arrangement at the top, which allows spring-deflective support of drill stem 3 with decoking tool 24 fixed at its lower end with respect to housing 2.

For this purpose, housing 2 has a receiving means 25 with an annular slot 31 at its top end, in which a guide member 26 is supported in a radially sprung or free-floating manner, which is held by means of 4 spring elements 5 on a frame 27 of sections 27*a* in a manner to be derived from the drawings. An inner housing 28 arranged in an axis-parallel position with respect to outer housing 2 is guided in guiding member 26 vertically moveable with respect to housing 2. This arrangement will be explained in more detail in the following.

Receiving means 25 consists of a flange 25*a* extending inwards and outwards (with respect to the wall of housing 2) and an annular and stepped plate 25*b* bolted thereon (consisting of two plate halves capable of being bolted together), which form between them the annular slot 31 for guiding member 26 and have venting holes 25*c*, also for pressure compensation. Guiding member 26 consists of a bearing sleeve 29 and an annular plate portion 30 radially extending to the outside from the latter, with which guide member 26 is supported in receiving means 25 in annular slot 31 in a radially deflective manner, and which is provided with a gliding lining 30*a* on its lower surface, as can be seen particularly clearly from FIG. 11.

Figure 11:
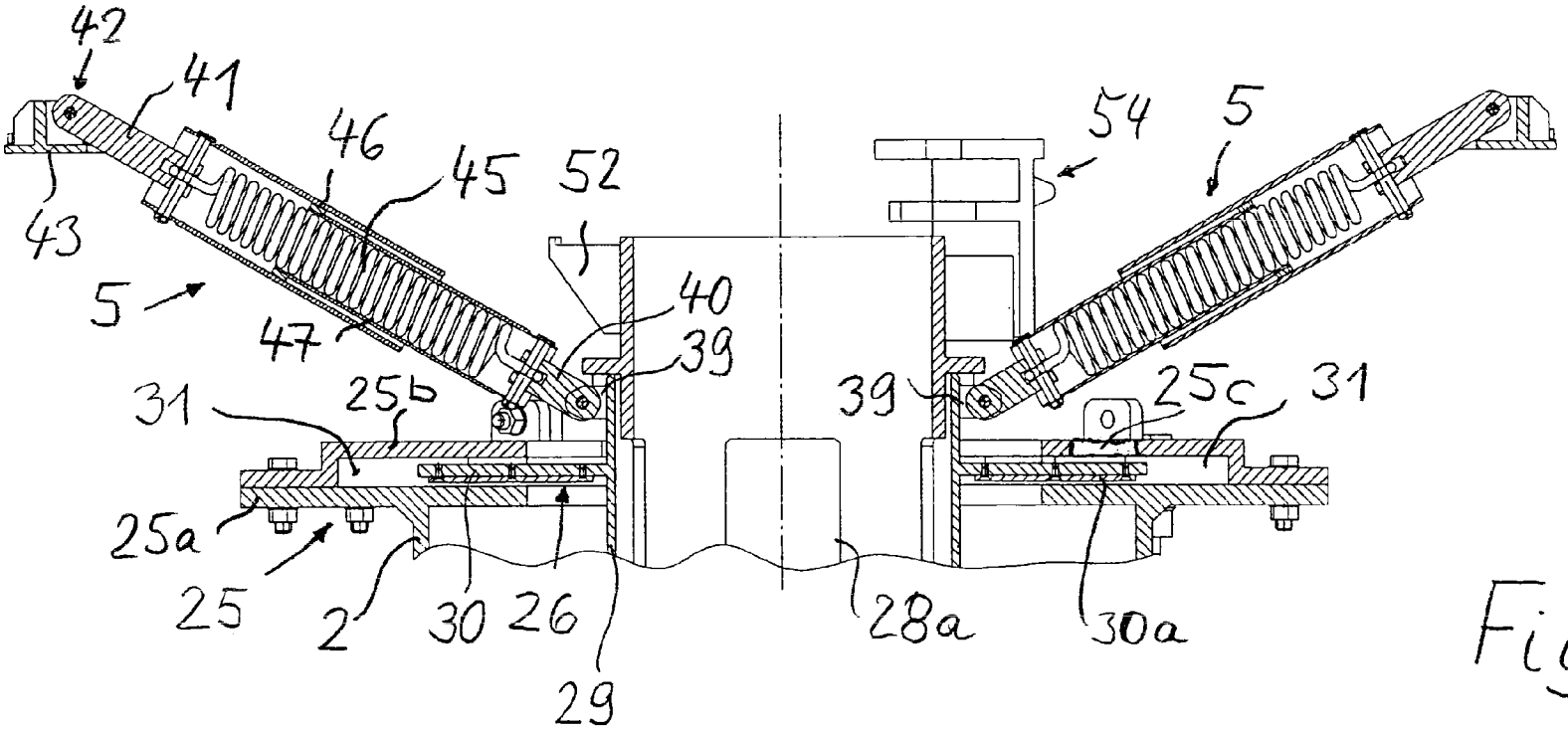
FIG. 11 is a sectional view of the top area of the outer housing of FIG. 7 to illustrate a suspension of the inner container by means of spring elements.

The four spring elements 5 are pivotably linked, as can be derived from FIG. 11, in particular, by means of eyes 39 fixed on the portion of bearing sleeve 29 protruding at the top, by each end 40. By their other ends 41, spring elements 5 each form pivoting links 42 on brackets 43 attached in pairs at corners of section frames 44 opposing each other in pairs on rails 27*a* of frame 27. Spring elements 5 each have a coil spring 45 within two sleeves 46, 47 in telescopic engagement with each other in the arrangement indicated in the drawing. Spring elements 5 hold and guide guiding member 26 and absorb, in particular, shock-like stresses of guiding member 26 and therefore of the drill stem guide.

Sliding bearing 4*a* of drill stem 3 is at the top end of inner housing 28 and consists of two bearing halves 48, 49, which can be outwardly pivoted about a pivot pin 50 in an attachment 54 for opening sliding bearing 4*a*, and thus held on supports 52 (FIG. 10), if the securing pin 51 in an attachment 53, which fixes the two bearing halves 48, 49, is released in advance. Once sliding bearing 4*a* has been opened, the drill stem 3 together with catching flange 38 can be lifted out of inner housing 28 together with decoking tool 24, which is necessary, in particular, for replacement of decoking tool 24 or other work on decoking tool 24. Lifting out of drill stem 3 with decoking tool 24 while sliding bearing 4*a* is open, is usually carried out in the position of inner housing 28 with respect to housing 2 as seen from FIG. 7.

Figure 8:
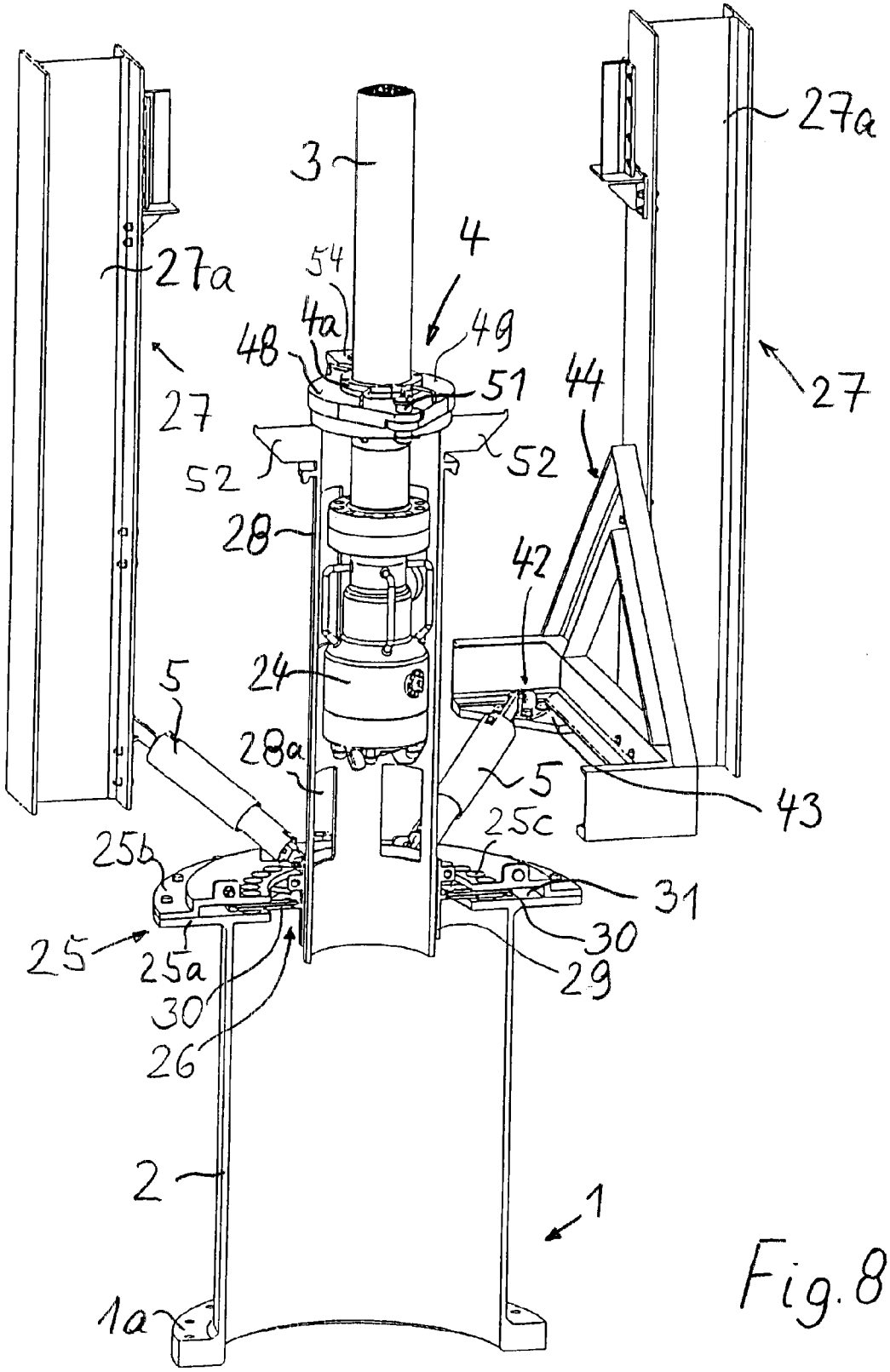
FIG. 8 is a similar perspective view of an arrangement as in FIG. 7, showing, however, an inner housing lifted with respect to the outer housing.
Figure 10:
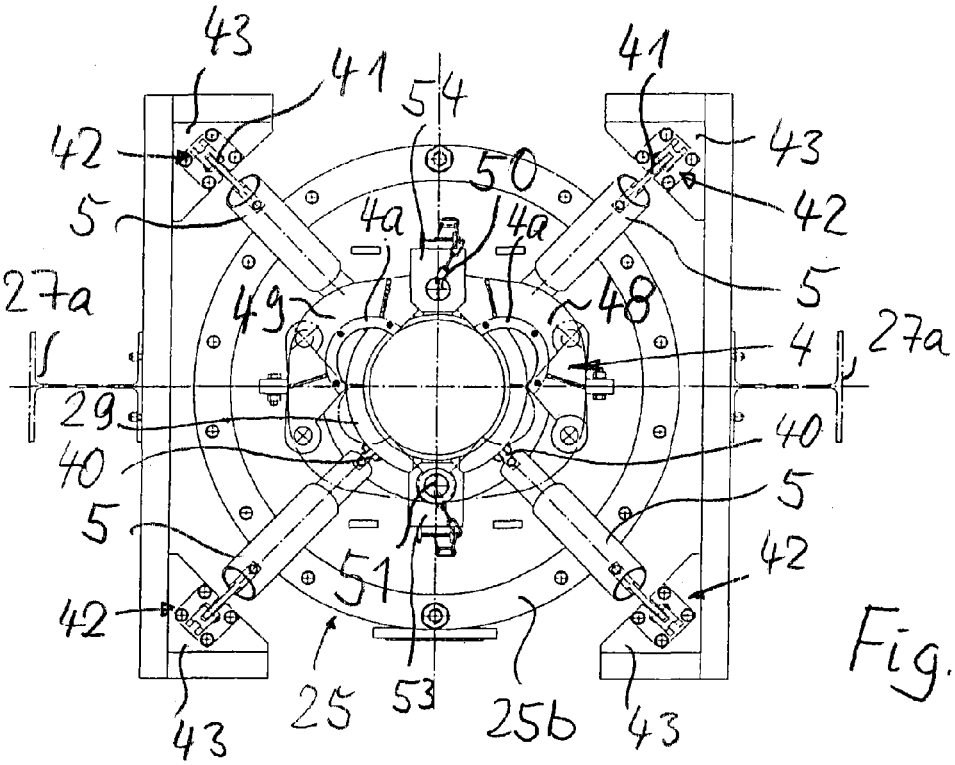
FIG. 10 is a plan view as in FIG. 9, showing, however, a drill stem guiding in an opened position.
Figure 9:
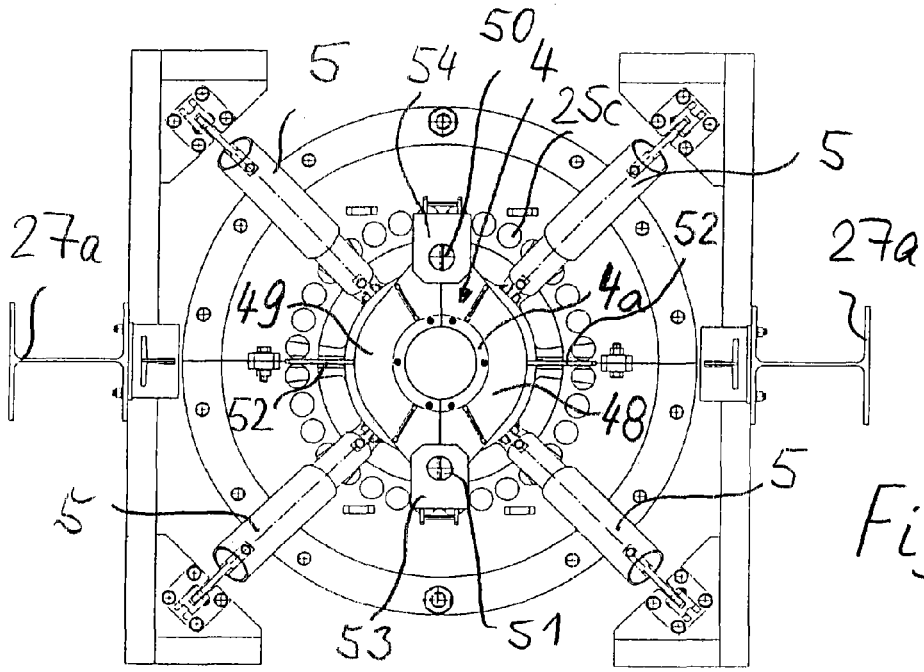
FIG. 9 is a plan view of the arrangement according to FIG. 6, showing a centered drill stem guiding.

While container 23 is filled with coke, decoking tool 24 is preferably in inner container 28 in the rest position seen in FIG. 8, in which decoking tool 24 is ventilated via ventilating openings 28*a* and can be protected against excessive temperatures.

If container 23 is deformed due to thermally induced stresses and container opening 23*a* (FIG. 1) is displaced, valve 32, adapter 35, and also housing 2, must follow this displacement. Meanwhile, sliding bearing 4 together with drill stem 3 can maintain their axial positions, while guiding member 26 moves within annular slot 31 radially relative to receiving means 25 and housing 2, i.e. can maintain its position. In other words, outer housing 2 leaves its horizontal position corresponding to the displacement of container opening 23*a*, while guiding member 26 maintains its former position, which means that the position of sliding guide 4 of drill stem 3 also remains unchanged. Bending stresses on drill stem 3 are thus avoided as the position of container opening 23*a* varies.

The invention claimed is:

1. An apparatus for guiding a drill stem of a decoking tool working in an interior of a container in which coke is deposited, the apparatus comprising:

a guide plate having means for attachment to the container, the guide plate having an opening through which the drill stem passes;

a sliding guide connected to the drill stem and operable to move with respect to the guide plate; and at least one spring element connected to the sliding guide for urging the sliding guide to move horizontally with respect to the guide plate.

2. The apparatus of claim 1, wherein the sliding guide includes a sliding bearing in which the drill stem is guided, and the at least one spring element effectively connects the sliding bearing to a frame connected to the guide plate.

3. The apparatus of claim 2, further comprising a housing in which the sliding bearing is disposed, the housing connected to the frame by the at least one spring element.

4. The apparatus of claim 1, wherein the at least one spring element comprises from two to five spring elements that connect the sliding guide to a frame connected to the guide plate.

5. The apparatus of claim 1, further comprising a housing and the sliding guide including a sliding bearing disposed within the housing for supporting the drill stem, wherein the sliding bearing is spring-deflected with respect to the housing by means of the at least one spring element, and wherein the housing is fixed to a frame connected to the guide plate.

6. The apparatus of claim 1, further comprising a housing, wherein the at least one spring element comprises one or more spring-damper elements for connecting the sliding guide to one or more of the housing and the guide plate.

7. The apparatus of claim 1, wherein the at least one spring element is configured to compensate for positional changes of the guide plate.

8. The apparatus of claim 1, further comprising:

a housing mounted on the guide plate;

a guiding member connected to the sliding guide; and receiving means for receiving and supporting the guiding member, the receiving means attached to the housing, and extending essentially transverse to an axis of the drill stem.

9. The apparatus of claim 8, wherein the guiding member is held on a frame by the at least one spring element.

10. The apparatus of claim 9, wherein the at least one spring element is each pivotably linked with the frame and the guiding member.

11. The apparatus of claim 8, wherein the receiving means and the guiding member each have an annular construction.

12. The apparatus of claim 8, wherein further comprising an inner housing connected to the guiding member, the inner housing accommodating the sliding guide.

13. The apparatus of claim 12, wherein the inner housing is guided in the guiding member and is vertically moveable relative to the housing.

14. The apparatus of claim 8, wherein the guiding member comprises a bearing sleeve and an annular plate part radially extending therefrom, and the guiding member is supported in an annular slot in the receiving means in a manner capable of radial deflection.

* * * * *